US007147577B2

(12) United States Patent
Nakahara et al.

(10) Patent No.: US 7,147,577 B2
(45) Date of Patent: Dec. 12, 2006

(54) HOLLOW GOLF CLUB HEAD

(75) Inventors: Norihiko Nakahara, Hiratsuka (JP); Masahiko Miyamoto, Hiratsuka (JP); Shinji Yamamoto, Hiratsuka (JP)

(73) Assignee: The Yokohama Rubber Co., Ltd., Tokyo (JP)

( * ) Notice: Subject to any disclaimer, the term of this patent is extended or adjusted under 35 U.S.C. 154(b) by 0 days.

(21) Appl. No.: 11/411,153

(22) Filed: Apr. 26, 2006

(65) Prior Publication Data

US 2006/0189411 A1 Aug. 24, 2006

Related U.S. Application Data

(62) Division of application No. 10/338,699, filed on Jan. 9, 2003, now Pat. No. 7,063,629.

(30) Foreign Application Priority Data

Jan. 11, 2002 (JP) ..... 2002-004675

(51) Int. Cl.
*A63B 53/04* (2006.01)

(52) U.S. Cl. ..... 473/345; 473/347; 473/348; 473/349

(58) Field of Classification Search ..... 473/342, 473/345, 346, 347, 348, 349, 350
See application file for complete search history.

(56) References Cited

U.S. PATENT DOCUMENTS

| | | | | |
|---|---|---|---|---|
| 3,353,826 | A * | 11/1967 | Traverse | 473/561 |
| 5,433,440 | A | 7/1995 | Lin | |
| 5,624,331 | A | 4/1997 | Lo et al. | |
| 5,993,329 | A | 11/1999 | Shieh | |
| 6,050,904 | A | 4/2000 | Kuo | |
| 6,749,524 | B1 | 6/2004 | Chen | |
| 2003/0032500 | A1 | 2/2003 | Nakahara et al. | |
| 2003/0083151 | A1 | 5/2003 | Nakahara et al. | |
| 2003/0125127 | A1 | 7/2003 | Nakahara et al. | |
| 2003/0207726 | A1 | 11/2003 | Lee | |
| 2004/0116207 | A1 | 6/2004 | Shiell et al. | |
| 2004/0116208 | A1 | 6/2004 | Shiell et al. | |

* cited by examiner

*Primary Examiner*—Sebastiano Passaniti
(74) *Attorney, Agent, or Firm*—Finnegan, Henderson, Farabow, Garrett & Dunner, L.L.P.

(57) ABSTRACT

A hollow golf club head enables to increase the bonding strength of an outer shell member made of metal and an outer shell member made of fiber reinforced plastic. The hollow golf club head comprises a hollow golf club having a head body of a hollow structure formed by bonding the metallic outer shell member and the fiber reinforced plastic outer shell member, wherein the fiber reinforced plastic outer shell member is bonded to both faces of the bonding portion of the metallic outer shell member.

4 Claims, 4 Drawing Sheets

HOLLOW GOLF CLUB HEAD

RELATED APPLICATIONS

This application is a divisional of U.S. application Ser. No. 10/338,699 filed Jan. 9, 2003, now U.S. Pat. No. 7,063,629 the contents of which are incorporated herein by reference.

BACKGROUND OF THE INVENTION

The present invention relates to a golf club head having a hollow structure, and in particular relates to a hollow golf club head designed to increase the bonding strength of an outer shell member made of metal and an outer shell member made of fiber reinforced plastic.

DETAILED DESCRIPTION OF THE PRIOR ART

For example, in Japanese Patent No.2764883, Japanese patent application Kokai publication No.2000-229135, Japanese patent No.2773009, golf club heads made up by combining different materials are disclosed. According to golf club heads like these, there are advantages such that the position of the center of gravity can be set optionally based on the combination of metal material and a plastic material and that the head volume can be increased to the maximum within a limited head mass, and improvements of the performance of the golf club is possible, including the flying distance and directional performance.

However, when having a head body of a hollow structure formed by bonding a metallic outer shell member and fiber reinforced plastic outer shell member, it was very difficult to secure sufficient durability as a golf club head because it was not possible to obtain sufficient bonding strength.

SUMMARY OF THE INVENTION

It is an object of the present invention to provide a hollow golf club head that makes it possible to increase the bonding strength of an outer shell member made of metal and an outer shell member made of fiber reinforced plastic.

The hollow golf club head according to the present invention to attain the above-mentioned object is a golf club head having a head body of a hollow structure formed by bonding an outer shell member made of metal and an outer shell member made of fiber reinforced plastic, wherein the bonding portion of fiber reinforced plastic outer shell member is bonded to both faces of the bonding portion of metallic outer shell member.

By bonding the bonding portion of fiber reinforced plastic outer shell member to both faces of the bonding portion of metallic outer shell member, it is possible to increase the bonding strength of the outer shell member made of these different materials. Accordingly, it is possible to increase the performance of the golf club, including the flying distance and the directional performance, based on the combination of different materials, while securing the durability as a golf club head.

In the above-mentioned golf club head, to increase further the bonding strength of the metallic outer shell member and the fiber reinforced plastic outer shell member, it is desirable to reduce the thickness of the bonding portion of the metallic outer shell member gradually toward the end part thereof, to be provided with a plurality of notches at the bonding portion of the metallic outer shell member, or to be provided with a through hole at the bonding portion of the metallic outer shell member.

Moreover, the hollow golf club head according to the present invention to attain the above-mentioned object is a golf club having a head body of a hollow structure formed by bonding an outer shell member made of metal and an outer shell member made of fiber reinforced plastic, wherein the bonding portion of the fiber reinforced plastic outer shell member is bonded to the bonding portion of the metallic outer shell member, a through hole is provided in the bonding portion of the metallic outer shell member, a stitching member made of fiber reinforced plastic is passed through the through hole, and the metallic outer shell member and the fiber reinforced plastic outer shell member are coupled by the stitching member.

Like this, by bonding the bonding portion of the fiber reinforced plastic outer shell member to the bonding portion of the metallic outer shell member, and, by being provided with a through hole in the bonding portion of the metallic outer shell member, passing the fiber reinforced plastic stitching member through the through hole and coupling the fiber reinforced plastic outer shell member and the metallic outer shell member, it is possible to increase the bonding strength of the outer shell made of different materials. Accordingly, it is possible to increase the performance of the golf club, including the flying distance and the directional performance, based on the combination of different materials, while securing the durability as a golf club head.

In the present invention, to further increase the bonding strength of the metallic outer shell member and the fiber reinforced plastic outer shell member, it is desirable to make the surface roughness Ra of the bonding portion of the metallic outer shell member between 0.5 and 2.0. Moreover, as the fiber of the fiber reinforced plastic, the use of carbon fiber is desirable.

BRIEF DESCRIPTION OF THE DRAWINGS

FIG. 1(*a*) is a plan view, FIG. 1 *b*) is a front view, and FIG. 1(*c*) is a cross sectional view taken along line I—I in FIG. 1(*a*).

FIG. 2(*a*) is a plan view, and FIG. 2(*b*) is a cross sectional view.

FIG. 3(*a*) is a plan view, and FIG. 3(*b*) is a cross sectional view.

FIG. 4(*a*) is a plan view, and FIG. 4(*b*) is a cross sectional view.

FIG. 5(*a*) is a plan view, and FIG. 5(*b*) is a cross sectional view.

FIG. 6(*a*) is a plan view, and FIG. 6(*b*) is a cross sectional view.

DETAILED DESCRIPTION OF THE PREFERRED EMBODIMENT

Figure 1A:
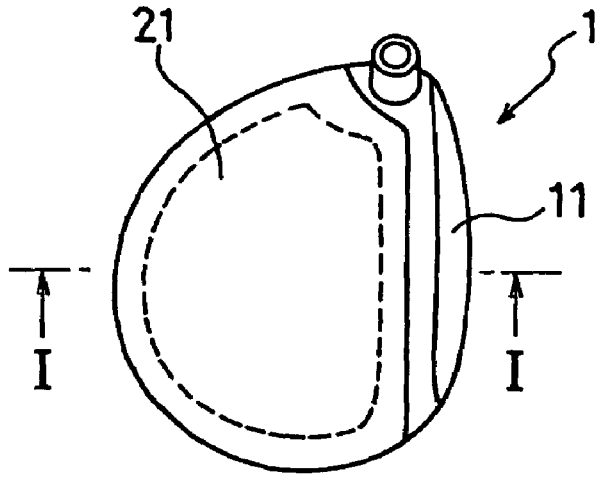
FIG. 1(*a*) through FIG. 1(*c*) show a golf club head as a preferable embodiment of the present invention.
Figure 1B:
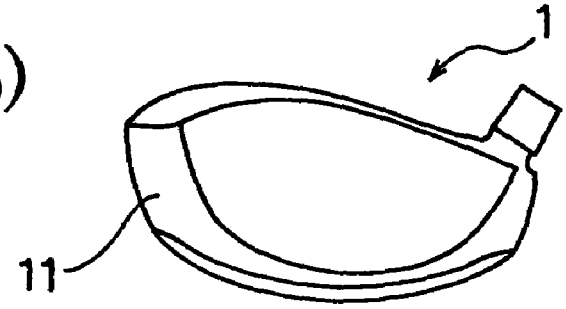
Figure 1C:
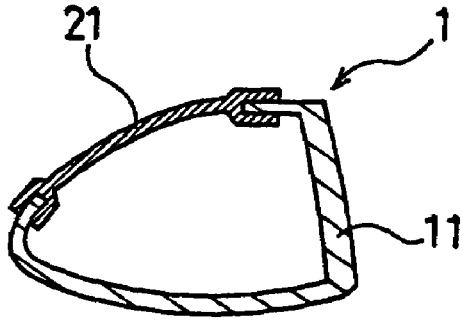

The composition of the present invention is described in detail while referring to the attached drawings, as follows:

FIG. 1(*a*) through FIG. 1(*c*) show a golf club head as a preferable embodiment of the present invention. As shown in FIG. 1(*a*) through FIG. 1(*c*), the golf club head of the present embodiment provides a head body 1 with a hollow structure made up by bonding an outer shell member made of metal 11, forming a face portion, sole portion and a neck portion, and an outer shell member made of fiber reinforced plastic 21, forming a crown portion.

In the above-mentioned hollow gold club head, it is possible, based on the combination of different materials, to set optionally the position of the center of gravity, and to increase the head volume to the maximum within a limited head mass, thereby improving the performance of the golf club including the flying distance and directional performance. However, the bonding strength is insufficient by merely lap-bonding the metallic outer shell member 11 and the fiber reinforced plastic outer shell member 21. Thus, in the present invention, these outer shell members of different materials are coupled with a high strength under the bonding condition described below.

Figure 2A:
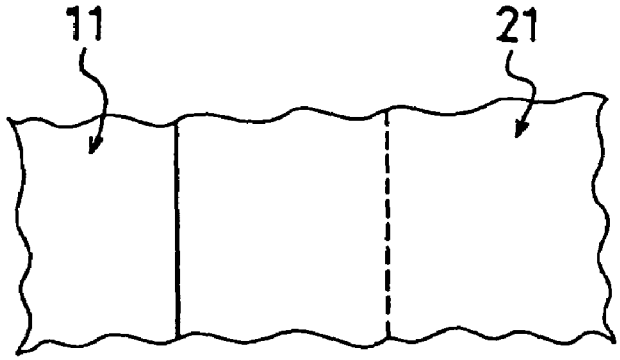
FIG. 2(*a*) and FIG. 2(*b*) show a first bonding condition in the golf club head of the present invention.
Figure 2B:
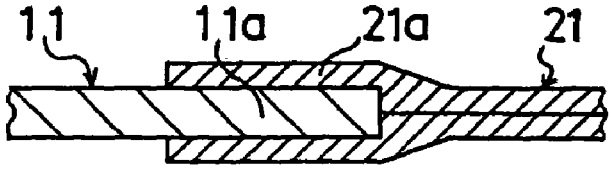

In the bonding condition of FIG. 2(*a*) and FIG. 2(*b*), the fiber reinforced plastic outer shell member 21 is bonded to both faces of a bonding portion 11*a* of the metallic outer shell member 11, by branching its bonding portion 21*a*. That is, the branched bonding portion 21*a* of the outer shell member 21 puts the bonding portion 11*a* of the outer shell member 11 in between. According to the above-mentioned bonding condition, the bonding area is increased by both-faces bonding, and thereby sufficient durability can be obtained as a golf club head.

Figure 3A:
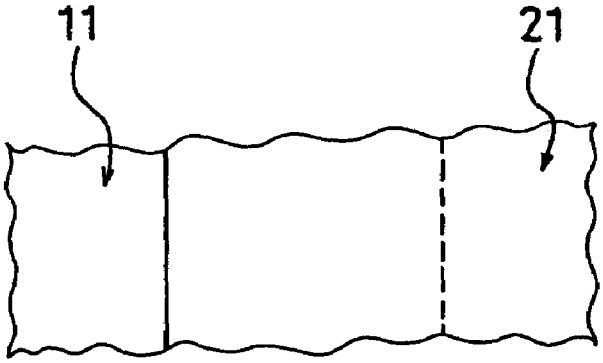
FIG. 3(*a*) and FIG. 3(*b*) show a second bonding condition in the golf club head of the present invention.
Figure 3B:
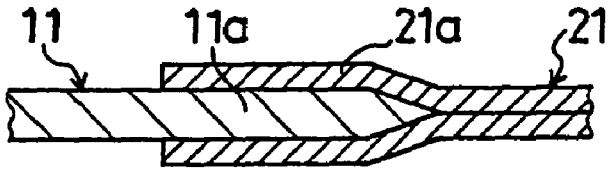

In the bonding condition of FIG. 3(*a*) and FIG. 3(*b*), the fiber reinforced plastic outer shell member 21 is bonded to both faces of the bonding portion 11*a* of the metallic outer shell member 11, by branching its bonding portion 21*a*, and the thickness of the bonding portion 11*a* of the metallic outer shell member 11 is decreased gradually toward an end part thereof. According to the above-mentioned bonding condition, stress concentration to the end face of the bonding portion 11*a* can be avoided, in addition the bonding area is increased by bonding both-faces, and thereby sufficient durability can be obtained as a golf club head.

Figure 4A:
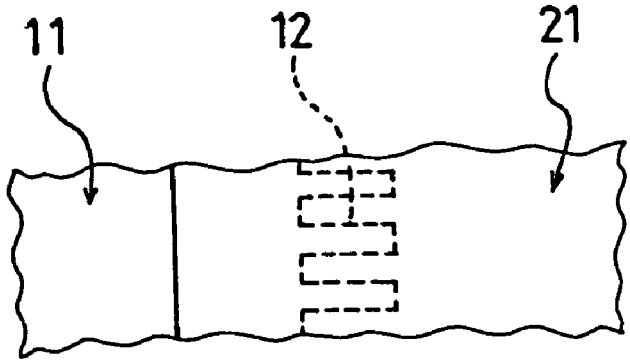
FIG. 4(*a*) and FIG. 4(*b*) show a third bonding condition in the golf club head of the present invention.
Figure 4B:
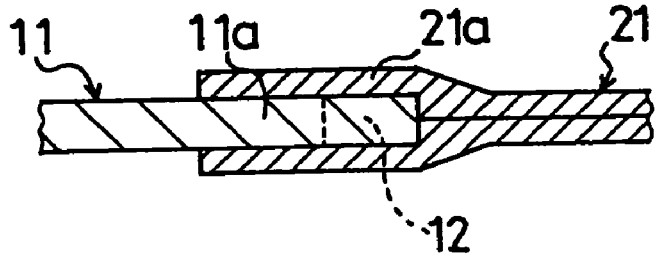

In the bonding condition of FIG. 4(*a*) and FIG. 4(*b*), the fiber reinforced plastic outer shell member 21 is bonded to both faces of the bonding portion 11*a* of the metallic outer shell member 11, by branching its bonding portion 21*a*, and a plurality of comb tooth-shaped notches 12 are provided in the bonding portion 11*a* of the metallic outer shell member 11. Consequently, the fiber reinforced plastic of the outer shell member 21 is also bonded into these notches 12. According to the above-mentioned bonding condition, the bonding area is increased by both-faces bonding and comb tooth processing, and thereby sufficient durability can be obtained as a golf club head.

Figure 5A:
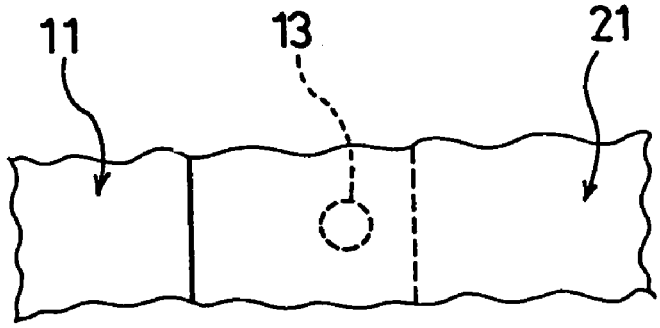
FIG. 5(*a*) and FIG. 5(*b*) show a fourth bonding condition in the golf club head of the present invention.
Figure 5B:
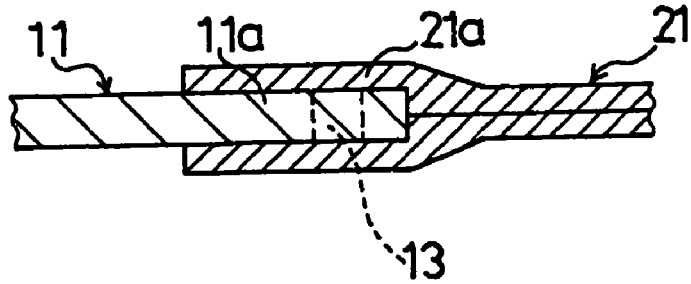

In the bonding condition of FIG. 5(*a*) and FIG. 5(*b*), the fiber reinforced plastic outer shell member 21 is bonded to both faces of the bonding portion 11*a* of the metallic outer shell member 11, by branching its bonding portion 21*a*, and a through hole 13 is provided in the bonding portion 11*a* of the metallic outer shell member 11. Consequently, the fiber reinforced plastic of the outer shell member 21 is also bonded into the through hole 13. According to the above-mentioned bonding condition, the bonding area is increased by both-faces bonding and hole drilling, and thereby sufficient durability can be obtained as a golf club head.

Figure 6A:
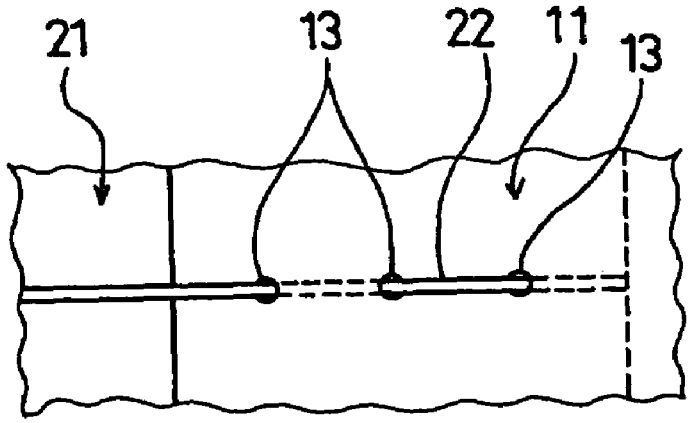
FIG. 6(*a*) and FIG. 6(*b*) show a fifth bonding condition in the golf club head of the present invention.
Figure 6B:
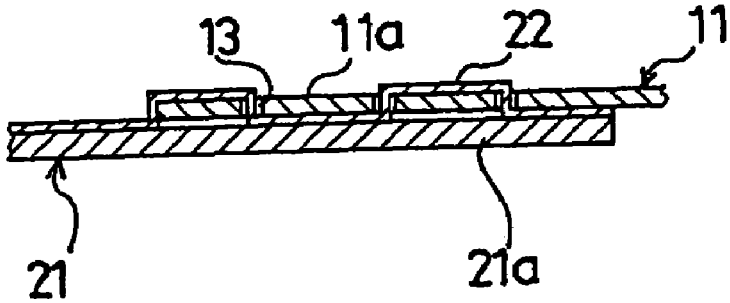

In the bonding condition of FIG. 6(*a*) and FIG. 6(*b*), the fiber reinforced plastic outer shell member 21 is bonded to both faces of the bonding portion 11*a* of the metallic outer shell member 11, by branching its bonding portion 21*a*, and, a plurality of through holes 13 is provided in the bonding portion 11*a* of the metallic outer shell member 11, a stitching member 22 made of fiber reinforced plastic is passed through the through hole 13, and by the stitching member 22, the fiber reinforced plastic outer shell member 21 and the metallic outer shell member 11 are coupled. According to the above-mentioned bonding condition, as the stitching member 22 binds solidly the fiber reinforced plastic outer shell member 21 to the metallic outer shell member 11, sufficient durability can be obtained as a golf club head. Incidentally, since the outer shell member 21 and the stitching member 22 are both plastic and their mutual bonding performance is good, so that these may simply closely come into contact with each other as illustrated, but by passing also the stitching member 22 through the fiber reinforced plastic outer shell member 21, more mechanical coupling strength can be obtained.

As the material for the outer shell member 11, metals like titanium alloy, aluminum alloy, stainless steel and the like can be used.

As the material for the outer shell member 12, fiber reinforced plastics made up by impregnating reinforcing fibers like carbon fiber, glass fiber, aramid fiber and the like in matrix resins like epoxy resin, unsaturated polyester resin, vinyl ester resin and the like can be used, and in particular the use of carbon fiber as the reinforcing fiber is preferable.

Moreover, to increase further the bonding strength of the metallic outer shell member 11 and the fiber reinforced plastic outer shell member 21, it is desirable to make the bonding portion 11*a* of the metallic outer shell member 11 0.5 to 2.0 in surface roughness Ra by polishing and the like.

In the above-mentioned embodiment, the case of having a head body of a hollow structure formed by bonding an outer shell member made of metal forming a face portion, sole portion and a neck portion, and an outer shell member made of fiber reinforced plastic forming a crown portion was described, however, in the present invention, the portion occupied by the metallic outer shell member and the portion occupied by the fiber reinforced plastic outer shell member is not specially limited.

EXAMPLE

In a hollow golf club head having a hollow structure by bonding an outer shell member made of metal and an outer shell member made of fiber reinforced plastic, Comparative example 1 (prior art) and Embodiments 1 to 5, with different bonding conditions, were prepared.

About these golf club heads, the durability of the bonding portion was evaluated, and the result is shown in Table 1. The result of evaluation is shown by indices with Comparative example 1 set as 100. About the durability of the bonding portion, larger index values mean that the durability is more favorable.

TABLE 1

| | Structure of bonding portion | Durability of bonding portion |
|---|---|---|
| Comparative example 1 | FRP bonding to one face of metal portion | 100 |
| Embodiment 1 | FRP bonding to both faces of metal portion (FIG. 2) | 110 |
| Embodiment 2 | FRP bonding to both faces of metal portion + thickness change (FIG. 3) | 115 |
| Embodiment 3 | FRP bonding to both faces of metal portion + notch (FIG. 4) | 114 |
| Embodiment 4 | FRP bonding to both faces of metal portion + through hole (FIG. 5) | 113 |
| Embodiment 5 | Through hole in metal portion + stitching member (FIG. 6) | 121 |

As it can be understood from Table 1, all the golf club heads of Embodiments 1 to 5 showed that the durability of the bonding portion was better compared to Comparative example 1.

According to the present invention, it is possible to increase the bonding strength of the metallic outer shell member and the fiber reinforced plastic outer shell member, in case where a head body with a hollow structure is formed by bonding an outer shell member made of metal and an outer shell member made of fiber reinforced plastic, because both outer shell members are bonded so that the fiber reinforced plastic straddles both faces of the bonding portion of the metallic outer shell member. Therefore, it is possible to increase the performance of the golf club, including the flying distance and the directional performance, based on the combination of different materials, while securing the durability as a golf club head.

Preferable embodiments of the present invention were described in detail as above, however, it should be understood that various changes, substitutes and replacements can be applied to this so far as within the spirit and scope of the present invention as stated by attached claims.

What is claimed is:

1. A hollow golf club head, comprising a head body having a hollow structure and formed by coupling together an outer shell member made of metal and an outer shell member made of fiber reinforced plastic at respective bonding portions of each, wherein the bonding portion of said fiber reinforced plastic outer shell member is bonded to the bonding portion of said metallic outer shell member, a through hole is provided in the bonding portion of said metallic outer shell member, a stitching member made of fiber reinforced plastic is passed through the through hole, and said metallic outer shell member and said fiber reinforced plastic outer shell member are coupled by the stitching member.

2. The hollow golf club head according to claim 1, wherein the bonding portion of the metallic outer shell member has a surface roughness Ra of 0.5 to 2.0.

3. The hollow golf club head according to claim 1, wherein the fiber of said fiber reinforced plastic is carbon fiber.

4. The hollow golf club head according to claim 1, wherein the bonding portion of the fiber reinforced plastic outer shell member is branched and the bonding portion of the metallic shell member contains a plurality of through holes through which is passed the stitching member.

* * * * *